US011117419B2

(12) United States Patent
Herbert

(10) Patent No.: US 11,117,419 B2
(45) Date of Patent: Sep. 14, 2021

(54) PAINT CAN CADDY

(71) Applicant: Lisa Herbert, Alexandria, VA (US)

(72) Inventor: Lisa Herbert, Alexandria, VA (US)

( * ) Notice: Subject to any disclaimer, the term of this patent is extended or adjusted under 35 U.S.C. 154(b) by 43 days.

(21) Appl. No.: 16/822,404

(22) Filed: Mar. 18, 2020

(65) Prior Publication Data

US 2020/0391540 A1 Dec. 17, 2020

Related U.S. Application Data

(60) Provisional application No. 62/860,730, filed on Jun. 12, 2019.

(51) Int. Cl.
*B44D 3/14* (2006.01)
*B44D 3/12* (2006.01)

(52) U.S. Cl.
CPC ..... *B44D 3/14* (2013.01); *B44D 3/123* (2013.01); *B44D 3/128* (2013.01)

(58) Field of Classification Search
CPC ..... B44D 3/14; B44D 3/128; B44D 3/123; B44D 3/12; B65D 25/2802; B65D 25/28
USPC ..... 220/737, 736, 735, 771, 752, 230; 15/146, 160, 159.1; 294/65.5; 248/311.2, 309.4, 309.1
See application file for complete search history.

(56) References Cited

U.S. PATENT DOCUMENTS 2,122,628 A 7/1938 Tracy
2,626,737 A 1/1953 Pitz
2,786,707 A * 3/1957 Campbell ..... A47G 21/145 294/34
2,788,153 A 4/1957 Broadbelt
D184,673 S 3/1959 Frasure
4,275,818 A * 6/1981 Church ..... B44D 3/123 15/257.05
4,972,964 A 11/1990 Escalante
(Continued)

FOREIGN PATENT DOCUMENTS

GB 711169 A 6/1954
GB 1190428 A * 5/1970 ..... B65D 25/20
GB 2518390 A 3/2015

OTHER PUBLICATIONS

"A99 Golf 3pcs/Pack Magnetic Paint Brush Holder Clip with Tin Opener Painiters DIY Tools Random Color"; printed on Jan. 29, 2020 from https://www.amazon.com/Magnetic-holder-Opener-Painiters-Random/dp/B076V5CYMV/ref=asc_df_B076V5CYMV/?tag=hyprod-20&linkCode=df0&hvadid=242012520696&hvpos=1o1&hvnetw=g&hvrand=13404067406793611993&hvpone=&hvptwo=&hvqmt=hvdev=c&hvdvcmdl=&hvlocint=&hvlocphy=9007809&hvtargid=pla-451032318216&psc=1.

*Primary Examiner* — Robert J Hicks
(74) *Attorney, Agent, or Firm* — Nath, Goldberg & Meyer; Richard C. Litman

(57) ABSTRACT

The paint can caddy is a holder and carrier for paint cans, as well as associated painting items, such as paint brushes and cleaning rags. The paint can caddy includes a receptacle having a cylindrical sidewall, an open upper end and a closed lower end. A brush holder is mounted on the cylindrical sidewall, adjacent the open upper end of the receptacle. The brush holder extends radially outwardly from the cylindrical sidewall and is angled with respect to the plane of the open upper end of the receptacle. At least one magnet is secured to the brush holder, allowing a paint brush with a magnetic or paramagnetic material embedded in its handle to be releasably secured to the brush holder. A handle is secured to an exterior surface of the cylindrical sidewall, allowing the receptacle to be easily carried and moved.

19 Claims, 4 Drawing Sheets

(56) References Cited

U.S. PATENT DOCUMENTS

| | | | | |
|---|---|---|---|---|
| 5,083,733 | A * | 1/1992 | Marino | B44D 3/123 248/110 |
| 5,217,193 | A * | 6/1993 | Drucker | B44D 3/14 248/148 |
| 5,584,520 | A | 12/1996 | Niemeier | |
| 6,260,663 | B1 | 7/2001 | Combs | |
| 6,394,304 | B1 | 5/2002 | Bohne et al. | |
| 6,827,233 | B1 * | 12/2004 | Scallate | B44D 3/125 220/603 |
| 7,527,310 | B2 | 5/2009 | Shaskey, Sr. | |
| 8,607,397 | B1 * | 12/2013 | Caver | A46B 9/026 15/160 |
| 9,815,319 | B2 | 11/2017 | Cooper | |
| 2008/0054030 | A1 * | 3/2008 | Diaz | B44D 3/14 224/148.7 |
| 2011/0259891 | A1 * | 10/2011 | Thibault | B44D 3/14 220/495.06 |
| 2015/0034777 | A1 | 2/2015 | Ionis | |

* cited by examiner

PAINT CAN CADDY

CROSS-REFERENCE TO RELATED APPLICATION

This application claims the benefit of U.S. Provisional Patent Application No. 62/860,730, filed on Jun. 12, 2019.

BACKGROUND

1. Field

The disclosure of the present patent application relates to holders and carriers, and particularly to a caddy for paint cans and the like.

2. Description of the Related Art

The use and handling of a conventional paint can presents numerous difficulties for a painter. For example, although paint cans are designed to sit on a flat surface, such as on a floor or a ladder shelf, the paint can must typically be held and/or moved during the actual painting process. In the case of quart and liter cans, such paint cans cannot be easily grasped in one hand, thus making holding and/or moving the cans difficult, particularly when the painter is holding a paint brush in his or her other hand.

Larger cans, such as gallon and multi-liter size paint cans, are provided with a wire bail handle, in which the wire is on the order of 1-2 mm thick. These cans are held by the bail itself, resulting in the can of paint being held vertically by the bail. This position, however, poses a problem of dipping the paint brush, since both the hand holding the bail and the bail itself block access to the paint in the can. In addition, a gallon can full of paint is also very heavy and hard to hold for an extended period of time.

In addition to the difficulties inherent in handling the paint can, the painting process is inherently prone to other difficulties, such as accidental drippage from the paint brush. Further, keeping other supplies, such as wiping rags, together with the can and brush is difficult, particularly since the painting process involves constant movement on the part of the painter. Thus, a paint can caddy solving the aforementioned problems is desired.

SUMMARY

The paint can caddy is a holder and carrier for paint cans, as well as associated painting items, such as paint brushes and cleaning rags. The paint can caddy includes a receptacle having a cylindrical sidewall, an open upper end and a closed lower end. The receptacle is sized and shaped to removably receive and hold a conventional paint can. An upper edge of the cylindrical sidewall, adjacent the open upper end, may have an annular groove formed therein for catching accidental drippage or spillage. A brush holder is mounted on the cylindrical sidewall, adjacent the open upper end of the receptacle. The brush holder extends radially outwardly from the cylindrical sidewall and is angled with respect to the plane of the open upper end of the receptacle; i.e., the brush holder is angled upwardly with respect to the open upper end of the receptacle, which is typically parallel to the horizontal.

At least one magnet is secured to the brush holder, allowing a paint brush with a magnetic or paramagnetic material embedded in its handle to be releasably secured to the brush holder. Due to the positioning and angle of the brush holder, the bristles of the brush may be positioned above the open paint can, at a downward angle, allowing paint to drip from the bristles back into the paint can.

A handle is secured to an exterior surface of the cylindrical sidewall, allowing the receptacle to be easily carried and moved. Additionally, at least one hook may be secured to the exterior surface of the cylindrical sidewall, allowing cleaning rags and the like to be suspended therefrom and moved along with the paint can and paint brush.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
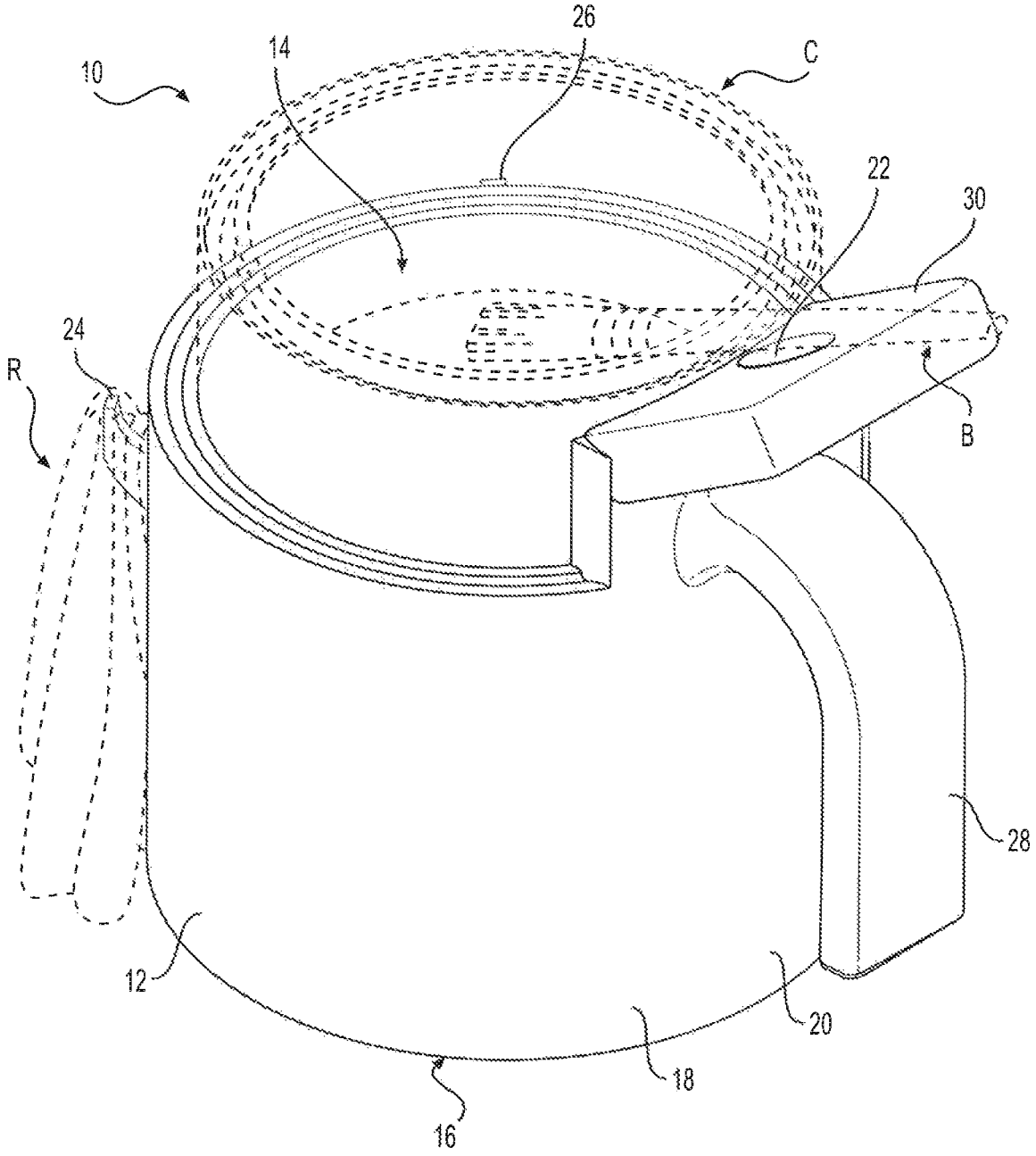
FIG. 1 is an environmental, perspective view of a paint can caddy.

As shown in FIG. 1, the paint can caddy 10 is a holder and carrier for paint cans, such as exemplary paint can C, as well as associated painting items, such as exemplary paint brush B and cleaning rag R. The paint can caddy 10 includes a receptacle 12 having a cylindrical sidewall 18, an open upper end 14 and a closed lower end 16. The receptacle 12 is sized and shaped to removably receive and hold a conventional paint can. It should be understood that paint can C is shown in FIG. 1 for exemplary purposes only. It should be further understood that receptacle 12 may be manufactured in a variety of different sizes to hold a variety of different paint cans.

Figure 2:
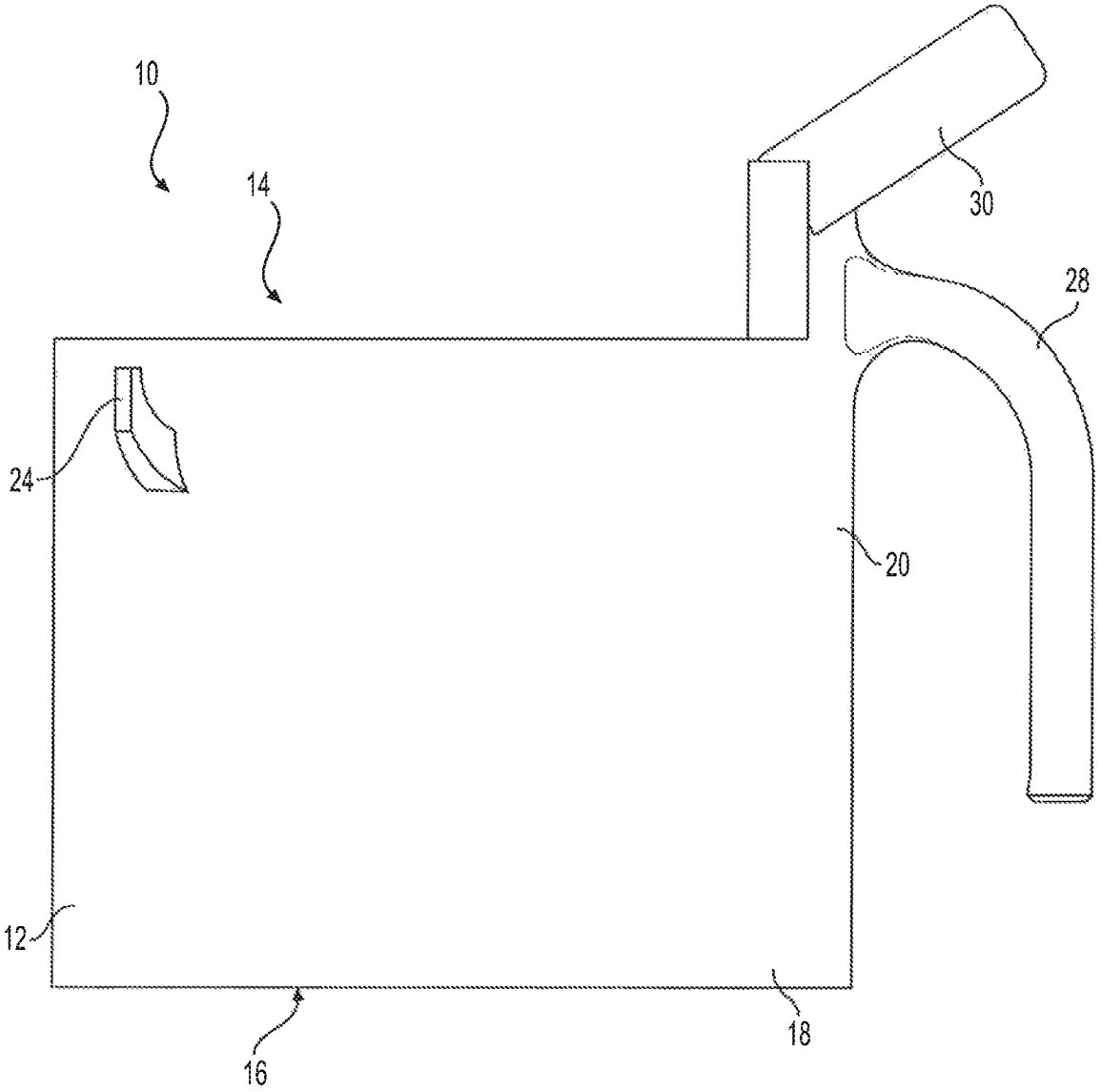
FIG. 2 is a side view of the paint can caddy.

As shown in FIGS. 1 and 2, a brush holder 30 is mounted on the cylindrical sidewall 18, adjacent the open upper end 14 of receptacle 12. The brush holder 30 extends radially outwardly from the cylindrical sidewall 18 and is angled with respect to the plane of the open upper end 14; i.e., the brush holder 30 is angled upwardly with respect to the open upper end 14, which is typically parallel to the horizontal. It should be understood that the brush holder 30 is shown in FIGS. 1-4 for exemplary purposes only, and may have any suitable overall contouring and relative dimensions.

Figure 3:
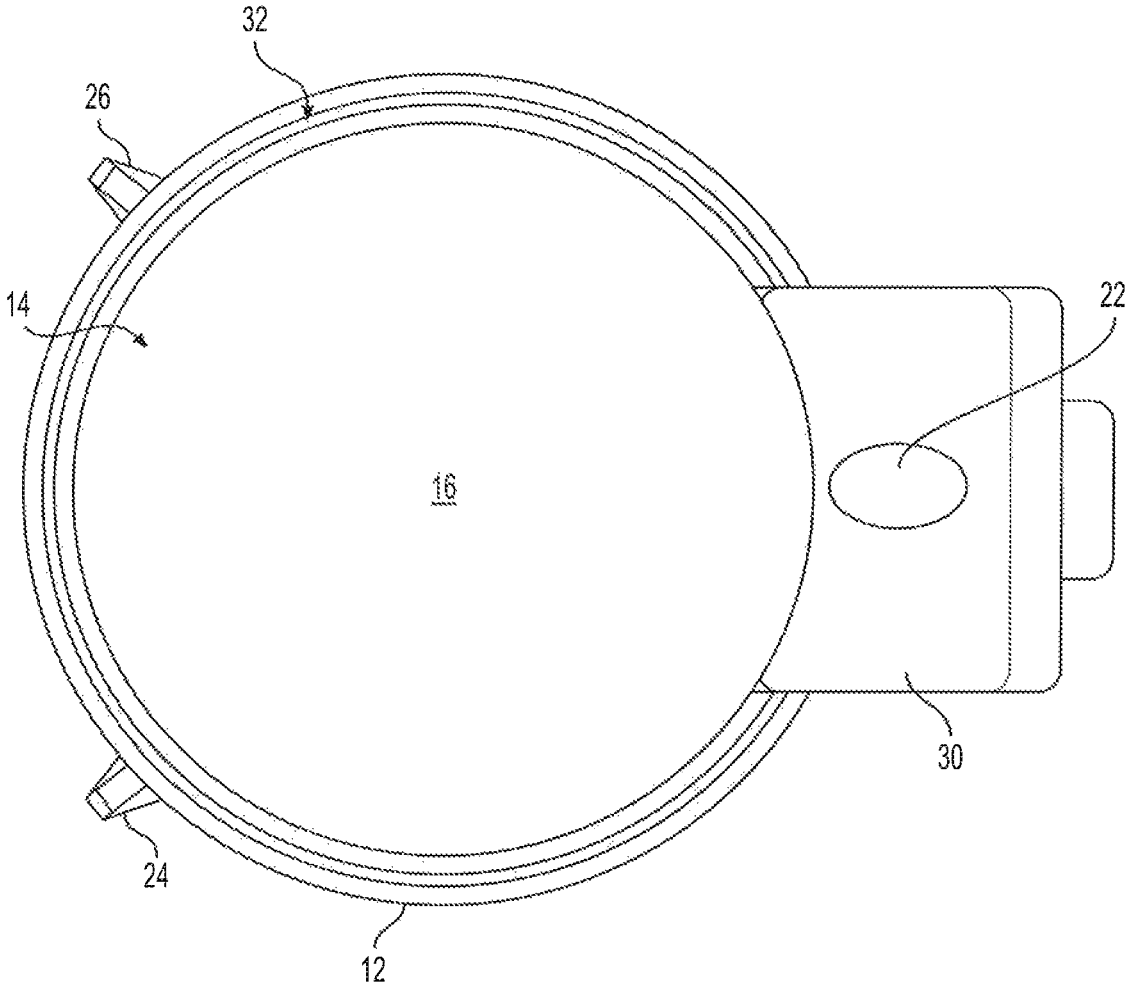
FIG. 3 is a top view of the paint can caddy.
Figure 4:
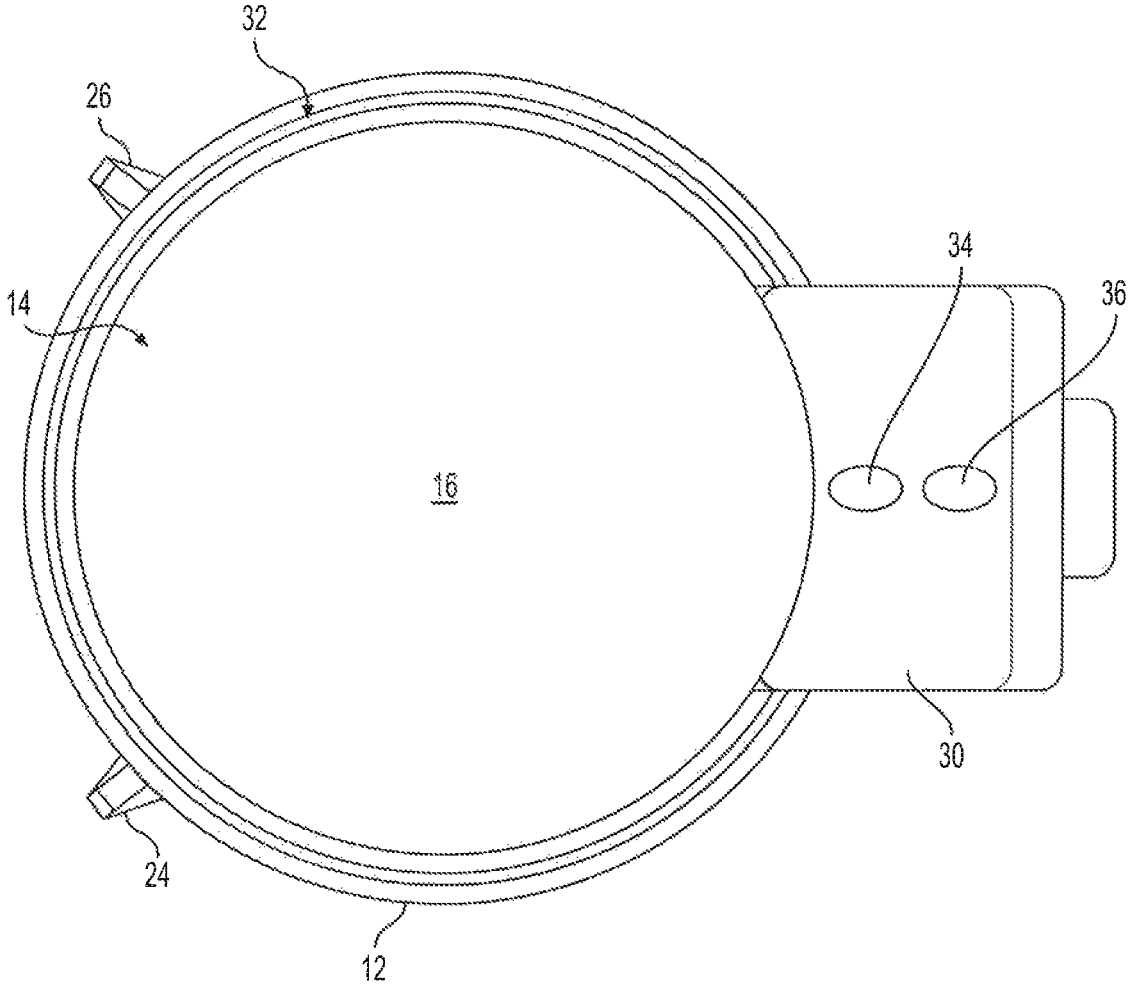
FIG. 4 is a top view of an alternative embodiment of the paint can caddy.

As best seen in FIGS. 3 and 4, at least one magnet is secured to the brush holder 30. In FIG. 3, a single exemplary magnet 22 is shown, and in FIG. 4, a pair of magnets 34, 36 are shown. It should be understood that the overall contouring and relative dimensions of magnets 22, 34, 36 are shown for exemplary purposes only. Further, it should be understood that any desired number of magnets may be provided. Additionally, it should be understood that magnets 22, 34, 36 may be secured to brush holder 30 in any suitable manner.

The single magnet 22 of FIG. 3 or the dual magnets 34, 36 of FIG. 4 allow a paint brush with a magnetic or paramagnetic material embedded in its handle to be releasably secured to the brush holder 30. As shown in FIG. 1, due to the positioning and angle of the brush holder 30, the bristles of brush B may be positioned above the open paint can C, at a downward angle, allowing paint to drip from the bristles back into paint can C.

A handle 28 is secured to an exterior surface 20 of the cylindrical sidewall 18, allowing the receptacle 12 to be easily carried and moved. As shown, the handle 28 may be positioned beneath the brush holder 30. It should be understood that the overall contouring and relative dimensions of handle 28 is shown for exemplary purposes only. Additionally, at least one hook may be secured to the exterior surface 20 of the cylindrical sidewall 18, allowing cleaning rags, such as exemplary cleaning rag R, and the like to be suspended therefrom and moved along with the paint can C and paint brush B. FIGS. 3 and 4 show a pair of hooks 24, 26 secured to cylindrical sidewall 18, approximately diametrically opposed from handle 28, however, it should be understood that any desired number of hooks may be secured to the cylindrical sidewall 18, and that the hooks may be positioned at any desired locations on cylindrical sidewall 18. It should be understood that the overall contouring and relative dimensions of hooks 24, 26 are shown for exemplary purposes only. Further, upper end 14 of receptacle 12 may have an annular groove 32 defined therein, as best seen in FIGS. 3 and 4. The annular groove 32 is provided for catching accidental drippage or spillage.

It is to be understood that the paint can caddy is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A paint can caddy, comprising:

a receptacle having a cylindrical sidewall, an open upper end and a closed lower end;

a brush holder mounted on the cylindrical sidewall, adjacent the open upper end of the receptacle, the brush holder extending radially outwardly from the cylindrical sidewall and being angled with respect to a plane defined by the open upper end of the receptacle;

at least one magnet secured to the brush holder; and a handle secured to an exterior surface of the cylindrical sidewall.

2. The paint can caddy as recited in claim 1, further comprising at least one hook secured to the exterior surface of the cylindrical sidewall.

3. The paint can caddy as recited in claim 2, wherein the at least one hook comprises a pair of hooks.

4. The paint can caddy as recited in claim 1, wherein the at least one magnet comprises a pair of magnets.

5. The paint can caddy as recited in claim 1, wherein an upper edge of the cylindrical sidewall, adjacent the open upper end of the receptacle, has an annular groove formed therein.

6. The paint can caddy as recited in claim 1, wherein the handle is positioned beneath the brush holder.

7. The paint can caddy as recited in claim 1, wherein the brush holder is angled upwardly with respect to the plane defined by the open upper end of the receptacle.

8. A paint can caddy, comprising:

a receptacle having a cylindrical sidewall, an open upper end and a closed lower end, wherein an upper edge of the cylindrical sidewall, adjacent the open upper end, has an annular groove formed therein;

a brush holder mounted on the cylindrical sidewall, adjacent the open upper end of the receptacle, the brush holder extending radially outwardly from the cylindrical sidewall and being angled with respect to a plane defined by the open upper end of the receptacle;

at least one magnet secured to the brush holder; and a handle secured to an exterior surface of the cylindrical sidewall.

9. The paint can caddy as recited in claim 8, further comprising at least one hook secured to the exterior surface of the cylindrical sidewall.

10. The paint can caddy as recited in claim 9, wherein the at least one hook comprises a pair of hooks.

11. The paint can caddy as recited in claim 8, wherein the at least one magnet comprises a pair of magnets.

12. The paint can caddy as recited in claim 8, wherein the handle is positioned beneath the brush holder.

13. The paint can caddy as recited in claim 8, wherein the brush holder is angled upwardly with respect to the plane defined by the open upper end of the receptacle.

14. A paint can caddy, comprising:

a receptacle having a cylindrical sidewall, an open upper end and a closed lower end;

a brush holder mounted on the cylindrical sidewall, adjacent the open upper end of the receptacle, the brush holder extending radially outwardly from the cylindrical sidewall and being angled upwardly with respect to a plane defined by the open upper end of the receptacle;

at least one magnet secured to the brush holder; and a handle secured to an exterior surface of the cylindrical sidewall.

15. The paint can caddy as recited in claim 14, further comprising at least one hook secured to the exterior surface of the cylindrical sidewall.

16. The paint can caddy as recited in claim 15, wherein the at least one hook comprises a pair of hooks.

17. The paint can caddy as recited in claim 14, wherein the at least one magnet comprises a pair of magnets.

18. The paint can caddy as recited in claim 14, wherein an upper edge of the cylindrical sidewall, adjacent the open upper end of the receptacle, has an annular groove formed therein.

19. The paint can caddy as recited in claim 14, wherein the handle is positioned beneath the brush holder.

* * * * *